US012416110B2

(12) United States Patent
Mueller et al.

(10) Patent No.: US 12,416,110 B2
(45) Date of Patent: Sep. 16, 2025

(54) NONWOVEN FABRICS MADE OF BICOMPONENT FIBERS

(71) Applicant: BASF SE, Ludwigshafen am Rhein (DE)

(72) Inventors: Daniel Mueller, Basel (CH); Sebastien Villeneuve, Huningue (FR)

(73) Assignee: BASF SE, Ludwigshafen am Rhein (DE)

( * ) Notice: Subject to any disclaimer, the term of this patent is extended or adjusted under 35 U.S.C. 154(b) by 172 days.

(21) Appl. No.: 16/303,194

(22) PCT Filed: May 12, 2017

(86) PCT No.: PCT/EP2017/061424
§ 371 (c)(1),
(2) Date: Nov. 20, 2018

(87) PCT Pub. No.: WO2017/207244
PCT Pub. Date: Dec. 7, 2017

(65) Prior Publication Data

US 2019/0323156 A1 Oct. 24, 2019

(30) Foreign Application Priority Data

May 31, 2016 (EP) ..... 16172182

(51) Int. Cl.
*D04H 3/147* (2012.01)
*D04H 3/005* (2012.01)

(52) U.S. Cl.
CPC ..... *D04H 3/147* (2013.01); *D04H 3/005* (2013.01)

(58) Field of Classification Search
CPC . C08K 5/3432; C08F 2/38; C08F 4/00; C07D 491/10; C07D 487/10; C07D 401/14; C07C 239/22
See application file for complete search history.

(56) References Cited

U.S. PATENT DOCUMENTS

2006/0128903 A1 6/2006 Roth et al.
2008/0045662 A1* 2/2008 Roth ..... C08J 11/28 525/240
2008/0146740 A1 6/2008 Roth et al.
2009/0209158 A1 8/2009 Richeson et al.
2011/0189916 A1 8/2011 Haubruge et al.

FOREIGN PATENT DOCUMENTS

WO WO 01/90113 A1 11/2001
WO WO 2007/126994 A1 11/2007
WO WO 2010/012769 A1 2/2010

OTHER PUBLICATIONS

International Search Report issued Jun. 23, 2017 in PCT/EP2017/061424 issued May 12, 2017.
Extended European Search Report issued Nov. 7, 2016 in Patent Application No. 16172182.4.
Erich Fahrbach, et al., "Nonwoven Fabrics", Ullmanns Encyclopedia of Industrial Chemistry, vol. 24, 2000, pp. 585-608.

* cited by examiner

*Primary Examiner* — Jenna N Chandhok
(74) *Attorney, Agent, or Firm* — Grüneberg and Myers PLLC

(57) ABSTRACT

The present invention relates to nonwoven fabrics comprising bicomponent fibers, wherein the bicomponent fibers comprise at least two distinct polymeric domains a) and b) in intimate adherence along the length of the fibers, and —polymeric domain a) comprises a compound of formula (1), wherein the substituents are as defined in the specification, and —polymeric domain b) is free of the compound of formula (1), as well as to the preparation of such nonwoven fabrics. Furthermore, the present invention is directed to corresponding bicomponent fibers.

(1)

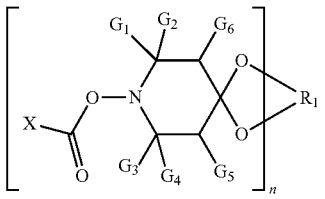

19 Claims, No Drawings

NONWOVEN FABRICS MADE OF BICOMPONENT FIBERS

The present invention relates to nonwoven fabrics comprising bicomponent fibers, wherein the bicomponent fibers comprise at least two distinct polymeric domains a) and b) in intimate adherence along the length of the fibers, and wherein polymeric domain a) comprises a compound of formula (1) as defined below and polymeric domain b) is free of the compound of formula (1), as well as to the preparation of such nonwoven fabrics. Furthermore, the present invention is directed to corresponding bicomponent fibers.

Nonwoven fabrics find use in a variety of products such as bandaging materials, garments, disposable diapers, and other personal hygiene products, including pre-moistened wipes. Nonwoven fabrics having high levels of strength, softness, and abrasion resistance are desirable for disposable absorbent garments, such as diapers, incontinence briefs, training pants, feminine hygiene garments, and the like. For example, in a disposable diaper, it is highly desirable to have soft, strong, nonwoven components, such as topsheets or backsheets (also known as outer covers). This applies also to technical nonwovens like geotextiles, roofing or filters.

Tensile strength of nonwovens and elongation of fibers is important because the manufacture of nonwoven fabrics typically involves multiple steps (for example, rolling/unrolling, cutting, adhesion, etc.), and such fabrics lacking tensile strength may not survive one or more of these steps. Fibers and the fabrics made of these fibers with a high tensile strength are also advantaged over the ones with a low tensile strength because the former will experience fewer line breaks, and thus greater productivity will be obtained from the manufacturing line. Moreover, the end-use of many products also typically requires a level of tensile strength specific to the function of the component. Tensile strength must be balanced against the cost of the process used to achieve the higher tensile strength. Optimized fabrics will have the minimum material consumption (basis weight) to achieve the minimum required tensile strength for the manufacture and end-use of the fiber, component (for example, nonwoven fabrics and laminates) and article. This, for example, provides the producer of nonwoven fabrics with the option to reduce weight while keeping still good mechanical performance of the product.

Fiber extensibility/elasticity is another important criteria for nonwoven structures, particularly those used in hygiene and medical applications, because the characteristic translates to a better comfort and fit as the article made from the fiber will be able to be more body conforming in all situations.

A further important aspect is the processing safety. It is desired to run the process for the preparation of nonwoven fabrics under more moderate conditions at e.g. lower thermobonding temperature. In order to be able to do so, still good mechanical properties, like tensile strength and elongation, must be obtained at lower thermobonding temperature. This would allow to reduce the thermobonding temperature. Furthermore, energy savings will be a secondary benefit.

Therefore, there is still a need for nonwoven fabrics and laminates, having improved mechanical properties, as well as better processing security.

Accordingly, the present invention relates to nonwoven fabrics comprising bicomponent fibers, wherein the bicomponent fibers comprise at least two distinct polymeric domains a) and b) in intimate adherence along the length of the fibers, and polymeric domain a) comprises a compound of formula (1), (1)

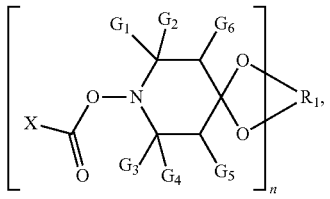

wherein $G_1$, $G_2$, $G_3$ and $G_4$ are each independently of the other $C_1$-$C_4$alkyl, or $G_1$ and $G_2$ together or $G_3$ and $G_4$ together are pentamethylene;

$G_5$ and $G_6$ are each independently of the other hydrogen or $C_1$-$C_4$alkyl; and X is hydrogen, $C_1$-$C_{18}$alkyl, $C_2$-$C_{18}$alkenyl, —O—$C_1$-$C_{18}$alkyl, —NH—$C_1$-$C_{18}$alkyl, —N($C_1$-$C_6$alkyl)$_2$; phenyl, phenoxy or —NH-phenyl, n is 1 or 2, and when n is 1, $R_1$ is $C_2$-$C_8$alkylene or $C_2$-$C_8$hydroxyalkylene or $C_4$-$C_{36}$acyloxyalkylene, or, when n is 2, $R_1$ is $(—CH_2)_2C(CH_2—)_2$; and polymeric domain b) is free of the compound of formula (1).

Examples of any substituents that are $C_1$-$C_4$alkyl are methyl, ethyl, n-propyl, n-butyl, sec-butyl or tert-butyl.

Examples of any substituents that are $C_1$-$C_{18}$alkyl are methyl, ethyl, n-propyl, n-butyl, sec-butyl, tert-butyl, n-hexyl, n-octyl, 2-ethyl-hexyl, n-nonyl, n-decyl, n-undecyl, n-dodecyl, n-tridecyl, n-tetradecyl, n-hexadecyl, n-heptadecyl or n-octadecyl.

Examples of any substituents that are $C_2$-$C_{18}$alkenyl are 1-propenyl, allyl, methallyl, 2-butenyl, 2-pentenyl, 2-hexenyl, 2-octenyl or 4-tert-butyl-2-butenyl.

Examples of any substituents that are —O—$C_1$-$C_{18}$alkyl are corresponding substituents wherein $C_1$-$C_{18}$alkyl is as given above.

Examples of any substituents that are —NH—$C_1$-$C_{18}$alkyl are corresponding substituents wherein $C_1$-$C_{18}$alkyl is as given above.

Examples of any substituents that are —N($C_1$-$C_6$alkyl)$_2$ are corresponding substituents wherein the $C_1$-$C_6$alkyl radicals are independently from each other methyl, ethyl, n-propyl, n-butyl, sec-butyl or tert-butyl, like —N($CH_3$)$_2$ or —N($C_2H_5$)$_2$.

Examples of any substituents that are $C_2$-$C_8$alkylene are ethylene, propylene, 2,2-dimethylpropylene, tetramethylene, hexamethylene or octamethylene. Examples of $C_2$-$C_8$hydroxyalkylene are the corresponding radicals given above for $C_2$-$C_8$alkylene, which are substituted by one or two, especially by one, hydroxyl radical.

$C_4$-$C_{36}$acyloxyalkylene is preferably $C_1$-$C_{20}$acyloxy-$C_3$-$C_{10}$alkylene. Examples of any substituents that are $C_4$-$C_{36}$acyloxyalkylene are groups of the formula (2)

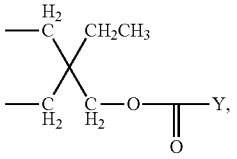

wherein Y is $C_1$-$C_{20}$alkyl, like the group of formula (2a)

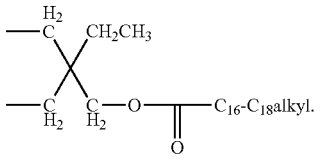

$G_1$, $G_2$, $G_3$ and $G_4$ are preferably $C_1$-$C_4$alkyl, especially methyl or ethyl. More preferably, $G_1$ and $G_3$ are methyl and $G_2$ and $G_4$ are ethyl.

$G_5$ and $G_6$ are preferably hydrogen or methyl. More preferably, $G_5$ is hydrogen and $G_6$ is methyl.

X is preferably hydrogen, $C_1$-$C_{18}$alkyl, —O—$C_1$-$C_{18}$alkyl, —NH—$C_1$-$C_{18}$alkyl or —N($C_1$-$C_6$alkyl)$_2$, especially hydrogen or $C_1$-$C_{18}$alkyl. More preferably, X is $C_1$-$C_4$alkyl, especially methyl.

It is preferred that n is 1.

Furthermore, it is preferred that n is 1 and $R_1$ is $C_2$-$C_8$alkylene or $C_4$-$C_{36}$acyloxyalkylene, especially $C_4$-$C_{36}$acyloxyalkylene. More preferably n is 1 and $R_1$ is a compound of formula (2), especially a compound of formula (2a).

It is highly preferred that the compound of formula (1) is a compound of formula (3)

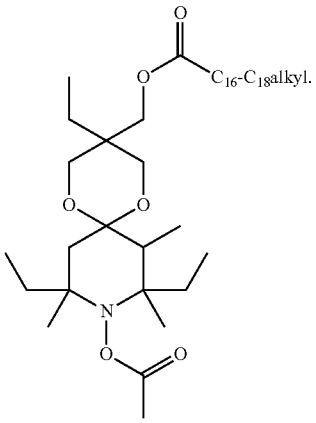

The compounds of formula (3) usually comprise mixtures of $C_{16}$-$C_{18}$ alkyl radicals, but may also contain only one of the alkyl radicals.

Compounds of formula (1) are known and can be prepared according to known methods, for example as given in WO 01/90113.

According to one aspect of the present invention polymeric domain a) comprises a compound of formula (3) and polymeric domain b) is free of a compound of formula (1), wherein $G_1$, $G_2$, $G_3$ and $G_4$ are each independently of the other $C_1$-$C_4$alkyl, or $G_1$ and $G_2$ together or $G_3$ and $G_4$ together are pentamethylene;

$G_5$ and $G_6$ are each independently of the other hydrogen or $C_1$-$C_4$alkyl; and X is hydrogen, $C_1$-$C_{18}$alkyl, $C_2$-$C_{18}$alkenyl, —O—$C_1$-$C_{18}$alkyl, —NH—$C_1$-$C_{18}$alkyl, —N($C_1$-$C_6$alkyl)$_2$; phenyl, phenoxy or —NH-phenyl, n is 1 or 2, and when n is 1, $R_1$ is $C_2$-$C_8$alkylene or $C_2$-$C_8$hydroxyalkylene or $C_4$-$C_{36}$acyloxyalkylene, or, when n is 2, $R_1$ is $(—CH_2)_2C(CH_2—)_2$.

Bicomponent fibers are meant to be fibers comprising at least two distinct polymeric domains a) and b) in intimate adherence along the length of the fibers. This means that the at least two polymeric domains are arranged in distinct zones across the cross-section of the bicomponent fibers and along the length of the fibers. It is to be understood that there can also be more than two polymeric domains, like three or four polymeric domains. Those having only two polymeric domains are preferred. The polymeric domains can be distinct from each other due to the polymer used and/or due to the additives present in the polymer.

The bicomponent fibers of the instant invention can be of any shape, and are not limited to a particular shape. Examples of such shapes are side-by-side; sheath-core, orange, and matrix and fibrils types, which are illustrated in Fahrbach, E., Schaut, G. and Weghmann, A., 2000, Nonwoven Fabrics, FIG. 3, Ullmann's Encyclopedia of Industrial Chemistry. Preferred are sheath-core type bicomponent fibers and side-by-side type bicomponent fibers, especially sheath-core type bicomponent fibers.

As to bicomponent fibers of the sheath-core type it is preferred that polymeric domain a) forms the sheath and polymeric domain b) the core.

The bicomponent fibers of the present invention comprise preferably 5 to 95 weight-% of polymeric domain a) and 5 to 95 weight-% of polymeric domain b). Particular preference is given to bicomponent fibers comprising 10 to 90 weight-% of polymeric domain a) and 10 to 90 weight-% of polymeric domain b), especially 20 to 80 weight-% of polymeric domain a) and 20 to 80 weight-% of polymeric domain b). Highly preferred are bicomponent fibers comprising 30 to 70 weight-% of polymeric domain a) and 30 to 70 weight-% of polymeric domain b). All percentages are based on the weight of the bicomponent fiber.

The diameter of the bicomponent fibers of the present invention can be any diameter suitable for the preparation of nonwoven materials. The diameter can range from 1 to 50 microns, with a preferred range of 1 to 20 microns, and a most preferred range of 1 to 10 microns. For non-round bicomponent fibers, for example, trilobal or X-shaped fibers, the diameter is measured across a circle circumscribing the outer edges of the fiber.

The bicomponent fibers of the present invention are known in the art and can be prepared by any method known in the art suitable for preparing bicomponent fibers. For example, bicomponent fibers can be produced by extruding two polymers from the same spinnerette with both polymers contained within the same filament.

Preferably the polymeric domains are thermoplastic polymers. More preferably, the polymeric domains, especially polymeric domains a) and b), are independently of each other a polyolefin, polyester, polyamide, polyvinyl chloride, polyimide, polyacrylonitrile, polycarbonate or polystyrene polymer, especially a polyolefin, polyester, polyamide, polycarbonate or polystyrene polymer.

Examples of polymers of olefins are monoolefins and diolefins, for example polypropylene, polyisobutylene, polybut-1-ene, poly-4-methylpent-1-ene, polyvinylcyclohexane, polyisoprene or polybutadiene, as well as polymers of cycloolefins, for instance of cyclopentene or norbornene, polyethylene (which optionally can be crosslinked), for example high density polyethylene (HDPE), high density and high molecular weight polyethylene (HDPE-HMW), high density and ultrahigh molecular weight polyethylene (HDPE-UHMW), medium density polyethylene (MDPE), low density polyethylene (LDPE), linear low density polyethylene (LLDPE), (VLDPE) and (ULDPE).

Polyolefins, i.e. the polymers of monoolefins exemplified in the preceding paragraph, preferably polyethylene and polypropylene, can be prepared by different, and especially by the following, methods:

a) radical polymerisation (normally under high pressure and at elevated temperature).

b) catalytic polymerisation using a catalyst that normally contains one or more than one metal of groups IVb, Vb, VIb or VIII of the Periodic Table. These metals usually have one or more than one ligand, typically oxides, halides, alcoholates, esters, ethers, amines, alkyls, alkenyls and/or aryls that may be either π- or σ-coordinated. These metal complexes may be in the free form or fixed on substrates, typically on activated magnesium chloride, titanium(III) chloride, alumina or silicon oxide. These catalysts may be soluble or insoluble in the polymerisation medium. The catalysts can be used by themselves in the polymerisation or further activators may be used, typically metal alkyls, metal hydrides, metal alkyl halides, metal alkyl oxides or metal alkyloxanes, said metals being elements of groups Ia, IIa and/or IIIa of the Periodic Table. The activators may be modified conveniently with further ester, ether, amine or silyl ether groups. These catalyst systems are usually termed Phillips, Standard Oil Indiana, Ziegler (-Natta), TNZ (DuPont), metallocene or single site catalysts (SSC).

Examples of mixtures of polyolefins are mixtures of polypropylene with polyisobutylene, polypropylene with polyethylene (for example PP/HDPE, PP/LDPE) and mixtures of different types of polyethylene (for example LDPE/HDPE).

Examples of copolymers of monoolefins and diolefins with each other or with other vinyl monomers, are ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, ethylene/vinylcyclohexane copolymers, ethylene/cycloolefin copolymers (e.g. ethylene/norbornene like COC), ethylene/1-olefins copolymers, where the 1-olefin is generated in-situ; propylene/butadiene copolymers, isobutylene/isoprene copolymers, ethylene/vinylcyclohexene copolymers, ethylene/alkyl acrylate copolymers, ethylene/alkyl methacrylate copolymers, ethylene/vinyl acetate copolymers or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned in 1) above, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

Examples of polystyrenes are poly(p-methylstyrene), poly(α-methylstyrene).

Polyamides may be polyamides and copolyamides derived from diamines and dicarboxylic acids and/or from aminocarboxylic acids or the corresponding lactams, for example polyamide 4, polyamide 6, polyamide 6/6, 6/10, 6/9, 6/12, 4/6, 12/12, polyamide 11, polyamide 12, aromatic polyamides starting from m-xylene diamine and adipic acid; polyamides prepared from hexamethylenediamine and isophthalic or/and terephthalic acid and with or without an elastomer as modifier, for example poly-2,4,4,-trimethylhexamethylene terephthalamide or poly-m-phenylene isophthalamide; and also block copolymers of the aforementioned polyamides with polyolefins, olefin copolymers, ionomers or chemically bonded or grafted elastomers; or with polyethers, e.g. with polyethylene glycol, polypropylene glycol or polytetramethylene glycol; as well as polyamides or copolyamides modified with EPDM or ABS; and polyamides condensed during processing (RIM polyamide systems).

Polyesters may be derived from dicarboxylic acids and diols and/or from hydroxycarboxylic acids or the corresponding lactones, for example polyethylene terephthalate, polybutylene terephthalate, poly-1,4-dimethylolcyclohexane terephthalate, polyalkylene naphthalate (PAN) and polyhydroxybenzoates, as well as block copolyether esters derived from hydroxyl-terminated polyethers; and also polyesters modified with polycarbonates or MBS.

For polycarbonates also polyester carbonates may be named.

It is preferred that at least one of the polymeric domains a) and b) is a polyolefin. As to the polymer of the other polymeric domain the definitions and preferences given above shall apply.

It is highly preferred that each of the polymeric domains a) and b) is a polyolefin, especially polyethylene or polypropylene, more preferably polypropylene.

As mentioned above, the polymeric domains can be distinct from each other due to the polymer used and/or due to the additives present in the polymer. The at least two distinct polymeric domains can be chemically different or they can be chemically the same polymer, but having different physical characteristics, such as tacticity, intrinsic viscosity, melt viscosity, die swell, density, crystallinity, and melting point or softening point. It is preferred that polymeric domains a) and b) comprise the same chemical type of polymer, like polypropylene, and are distinct from each other with respect to the presence of the compound of formula (1) in polymeric domain a). Highly preferred is that the polymers of polymeric domains a) and b) are chemically the same polymer and also have the same physical characteristics.

The polymeric domains are, usually, mainly composed of the polymers which may comprise customary additives. For example, the polymeric domains comprise at least 60 weight-%, especially at least 70 weight-%, more preferably at least 80 weight-% and most preferably at least 90 weight-% of polymer, based on the weight of the respective polymeric domain.

Customary additives of the polymers are, for example, antioxidants, processing stabilisers, light stabilisers, UV absorbers, fillers, reinforcing agents, pigments, metal deactivators, plasticisers, lubricants, emulsifiers, rheology additives, catalysts, flow-control agents, optical brighteners, flameproofing agents, antistatic agents and blowing agents.

It is preferred that domain a) comprises a mercaptan or a peroxide. In such case a ratio of the sum of the weight of mercaptan and peroxide to the weight of compound of formula (1) of 1:100 to 100:1, especially 1:10 to 10:1, is preferred.

More preferably, domain b) is free of mercaptanes and peroxides.

It is highly preferred that domain a) comprises a mercaptan or a peroxide, in a ratio of the sum of the weight of mercaptan and peroxide to the weight of compound of formula (1) of 1:100 to 100:1, especially 1:10 to 10:1, and domain b) is free of mercaptanes and peroxides.

The mercaptanes are preferably compounds of formula $$R—S—H \quad (4),$$

wherein R is $C_1$-$C_{40}$ alkyl which is unsubstituted or substituted by hydroxy or a group —SH. R is preferably unsubstituted $C_1$-$C_{40}$alkyl, especially $C_8$-$C_{40}$alkyl and more preferably $C_8$-$C_{18}$alkyl. As an example, octadecanethiol is mentioned.

Typical peroxides are 2,5-dimethyl-2,5-bis(tert.-butylperoxy)hexane (DHBP, for instance sold under the tradenames Luperox 101 and Trigonox 101), 2,5-dimethyl-2,5-bis(tert.-butyl-peroxy)hexyne-3 (DYBP, for instance sold under the tradenames Luperox 130 and Trigonox 145), dicumyl-peroxide (DCUP, for instance sold under the tradenames Luperox DC and Perkadox BC), di-tert.-butyl-peroxide (DTBP, for instance sold under the tradenames Trigonox B and Luperox Di), tert.-butyl-cumyl-peroxide (BCUP, for instance sold under the tradenames Trigonox T and Luperox 801), bis(tert.-butylperoxyisopropyl)benzene (DIPP, for instance sold under the tradenames Perkadox 14S and Luperox DC), 3,6,9-triethyl-3,6,9-trimethyl-1,4,7-triperoxonane (for instance sold under the tradename Trigonox 301), di(tert-butylperoxyisopropyl)benzene (for instance sold under the tradename Perkadox 14S-FL), dicetyl peroxydicarbonate (for instance sold under the tradename Perkadox 24L) and tert-butyl monoperoxymaleate (for instance sold under the tradename Perkadox PF-DBM25).

Preferred peroxides are 2,5-dimethyl-2,5-bis(tert.-butylperoxy)hexane (DHBP), tert.-butylcumyl-peroxide (BCUP) and 3,6,9-triethyl-3,6,9-trimethyl-1,4,7-triperoxonane, especially 2,5-dimethyl-2,5-bis(tert.-butyl-peroxy)hexane (DHBP) and 3,6,9-triethyl-3,6,9-trimethyl-1,4,7-triperoxonane.

It is preferred that the compound of formula (1) is present in polymeric domain a) in an amount of 0.0001 to 5% by weight, especially 0.001 to 5% by weight and more preferably 0.001 to 1% by weight, based on the weight of polymeric domain a). Highly preferred is an amount of 0.001 to 0.5% by weight.

Nonwoven fabrics used herein shall also include webs and shall mean a textile structure of individual fibers, filaments, or threads that are directionally or randomly oriented and bonded by friction, and/or cohesion and/or adhesion, as opposed to a regular pattern of mechanically inter-engaged fibers, i.e., it is not a woven or knitted fabric. Examples of nonwoven fabrics include spunbond continuous filament webs, carded webs, air-laid webs, and wet-laid webs. Suitable bonding methods include thermal bonding, chemical or solvent bonding, resin bonding, mechanical needling, hydraulic needling, stitchbonding, etc. An overview thereof is given in Fahrbach, E., Schaut, G. and Weghmann, A., 2000, Nonwoven Fabrics, Ullmann's Encyclopedia of Industrial Chemistry.

A further object of the present invention is a process for the preparation of nonwoven fabrics comprising bicomponent fibers having at least two distinct polymeric domains a) and b) in intimate adherence along the length of the fibers comprising:

i) separately melting at least two polymers wherein a first polymer comprises a compound of formula (1) as defined above, and a second polymer is free of the compound of formula (1), ii) directing the at least two polymers through spinneret orifices configured to form a plurality of bicomponent fibers, and iii) forming a layer from the fibers.

As to the process the definitions and preferences given hereinbefore shall apply.

For the process the fibers are spun from the respective polymers by the melt spinning process, according to which the molten polymers are extruded and forced through spinneret orifices.

Usually, the nonwoven fabrics are prepared in a process, according to which the fibers are spun from the respective polymers by the melt spinning process and then directly dispersed into a web. For example, the fibers are randomly laid on a collecting surface such as a screen or belt. The webs can be bonded by methods known in the art such as by hot-roll calendering or by passing the web through a saturated-steam chamber at an elevated pressure.

The temperature for the melt spinning process is, for example, 50 to 150° C. above the melting point of the corresponding polymer.

Thermal bonding (thermobonding) of the webs comprising the bicomponent fibers is often preferred. Bonding with contact heat and pressure is the most important bonding method. In calender bonding the web is bonded between two heated rolls with uniform pressure distribution over the machine width. In area bonding, pairs of steel-steel rolls as well as steel-coated rolls (e.g., with cotton or silicon) are used, depending on the weight and the required quality of the end product. For point bonding engraved rolls are used. Furthermore, thermal activation by means of hot air is to be named. The temperature for thermobonding is, for example, 5 to 40° C. below the melting point of the corresponding polymer.

A further object of the present invention are bicomponent fibers, comprising at least two distinct polymeric domains a) and b) in intimate adherence along the length of the fibers, wherein polymeric domain a) comprises a compound of formula (1), (1)

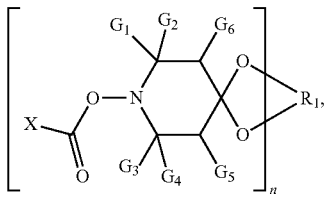

wherein $G_1$, $G_2$, $G_3$ and $G_4$ are each independently of the other $C_1$-$C_4$alkyl, or $G_1$ and $G_2$ together or $G_3$ and $G_4$ together are pentamethylene;

$G_5$ and $G_6$ are each independently of the other hydrogen or $C_1$-$C_4$alkyl; and X is hydrogen, $C_1$-$C_{18}$alkyl, $C_2$-$C_{18}$alkenyl, $C_2$-$C_{18}$alkynyl, —O—$C_1$-$C_{18}$alkyl, —NH—$C_1$-$C_{18}$alkyl, —N($C_1$-$C_6$alkyl)$_2$; phenyl, phenoxy or —NH-phenyl, n is 1 or 2, and when n is 1, $R_1$ is $C_2$-$C_8$alkylene or $C_2$-$C_8$hydroxyalkylene or $C_4$-$C_{36}$acyloxyalkylene, or, when n is 2, $R_1$ is $(—CH_2)_2C(CH_2—)_2$; and polymeric domain b) is free of the compound of formula (1).

As to the bicomponent fibers the definitions and preferences given hereinbefore shall apply.

The nonwoven fabrics according to the present invention, comprising specific bicomponent fibers wherein only one of domains a) and b) comprises a compound of formula (1), show improved properties with respect to tensile strength and elongation.

Improved properties with respect to tensile strength and elongation are of importance for, for example, the manufacture of nonwoven fabrics, since their preparation involves multiple steps and improved tensile strength or elongation helps to let them better survive these steps.

Importantly, higher tensile strength provides the producer of nonwoven fabrics with the option to e.g. reduce weight while keeping still good mechanical performance of the product.

Furthermore, distinctive lower amounts of compounds of formula (1) can be used, if in the bicomponent fibers only one of domains a) and b) comprises the compound of formula (1).

A further important aspect is the processing safety. It is desired to run the process for the preparation of nonwoven fabrics under more moderate conditions at lower thermobonding temperature. In order to be able to do so, still good mechanical properties, like tensile strength and elongation, must be obtained at lower thermobonding temperature. This allows to reduce the thermobonding temperature. Furthermore, energy savings will be a secondary benefit.

The following examples illustrate the invention.

EXAMPLES

A) Preparation of Nonwovens

Spunbond nonwovens are produced with polypropylene (Polypropylene HG475FB available from Borealis) with and without the Additive prepared as given below, on a 1 m wide Reicofil 4 line with a single beam having around 6800 holes per meter length. The holes have a diameter of 0.6 mm. Throughput per hole is set at 0.6 g/min. The line has a sheath-core configuration with 30% of the polymer in the sheath and 70% by weight of the polymer in the core. The Additive-containing fibers comprise the Additive only in the sheath, or for comparison purposes in all of the fiber. Furthermore for comparison fibers are prepared wherein both domains are free of the Additive. Nonwovens are produced with a fabric weight of 17 g/m$^2$ (line speed: 235 m/min) and 70 g/m$^2$ (line speed: 57 m/min), respectively. Target filament fineness is 2 dtex (dtex is a unit of measure for the linear mass density of fibers and is defined as the mass in grams per 10000 meters). The nonwovens are thermally bonded using an embossed roll.

The Additive given above and indicated in the following tables represents a mixture comprising 0.5% by weight of the compound of formula (3) and 99.5% by weight of polypropylene. Such mixture is prepared by mixing the compound of formula (3) with a polypropylene carrier (Moplen HP 561R) in a Berstorff twin screw extruder 25×32D at 200° C.

In case the Additive is used only in one polymeric domain, the given amount of Additive is based on the weight of only this polymeric domain (which in the examples is the weight of the sheath part).

In case the Additive is used in both polymeric domains, the given amount of Additive is based on the sum of the weight of both polymeric domains (which in the examples is the sum of the weight of the sheath and the core part).

Further processing conditions are given below:

Extruder temperature is the temperature used for extrusion of the polypropylene or polypropylene/Additive blend on the Reicofil 4 line and is in all examples 250° C.;

die temperature is the temperature of the polymer on the die and is in all examples 250° C.;

cabin pressure is the pressure in the cabin after and below the die and is in all examples 4500 Pa;

engraved and smooth rolls are rolls between which the fiber web is passed.

nip pressure is the pressure between the engraved and smooth roll and is in all examples 80 N/mm B) Evaluation of Mechanical Properties The mechanical properties of the nonwoven fabrics are determined according to DIN EN 29073-3 with a sample clamping length of 100 mm, sample width of 50 mm, advance (deformation speed) of 200 mm/min.

Tensile Strength MD and Elongation MD are the corresponding maximum values measured in machine direction.

Tensile Strength MC and Elongation MC are the corresponding maximum values measured in a direction perpendicular to the machine direction.

C) Results

TABLE 1

(fabric weight of nonwoven: 70 g/m$^2$)
Temperature of engraved roll: 153° C.
Temperature of smooth roll: 150° C.

| | Tensile strength MD [N] | Tensile strength MC [N] | Elongation MD [%] | Elongation MC [%] |
|---|---|---|---|---|
| No additive | 87 | 55 | 30 | 38 |
| 2% by weight of additive in all of the fibre, based on the weight of the whole fiber | 218 | 156 | 88 | 101 |
| 2% by weight of additive only in sheath, based on the weight of sheath part only. | 256 | 173 | 128 | 121 |

TABLE 2

| (fabric weight of nonwoven: 70 g/m$^2$) Temperature of engraved roll: 147° C. Temperature of smooth roll: 144° C. | | | | |
|---|---|---|---|---|
| | Tensile strength MD [N] | Tensile strength MC [N] | Elongation MD [%] | Elongation MC [%] |
| No additive | 66 | 43 | 21 | 33 |
| 2% by weight of additive in all of the fibre, based on the weight of the whole fiber | 196 | 140 | 83 | 93 |
| 2% by weight of additive only in sheath, based on the weight of sheath part only. | 228 | 157 | 106 | 110 |

TABLE 3

| (fabric weight of nonwoven: 17 g/m$^2$) Temperature of engraved roll: 153° C. Temperature of smooth roll: 150° C. | | | | |
|---|---|---|---|---|
| | Tensile strength MD [N] | Tensile strength MC [N] | Elongation MD [%] | Elongation MC [%] |
| No additive | 38 | 22 | 68 | 69 |
| 2% by weight of additive in all of the fibre, based on the weight of the whole fiber | 44 | 28 | 72 | 83 |
| 2% by weight of additive only in sheath, based on the weight of sheath part only. | 44 | 27 | 83 | 89 |

The results clearly demonstrate the advantages of the present invention, according to which significantly better results can be obtained with respect to mechanical properties, when compared to the use of no Additive or the use of the Additive in the whole fiber. This, for example, provides the producer of nonwovens with the option to reduce weight while keeping still good mechanical performance of the product.

Compared to the use of the Additive in the whole fiber, the use in only one polymeric domain allows to use distinctive lower amounts of Additive.

In addition, the data also clearly show the improvement of processing safety, being able to run the process under more moderate conditions at lower thermobonding temperature (see temperature of engraved roll and smooth roll). At lower thermobonding temperature still good mechanical properties are obtained, which consequently allows to reduce thermobonding temperature. Furthermore, energy savings will be a secondary benefit.

The invention claimed is:

1. A nonwoven fabric, comprising bicomponent fibers, wherein the bicomponent fibers comprise at least two distinct polymeric domains a) and b) in intimate adherence along the length of the bicomponent fibers, and polymeric domain a) comprises a compound of formula (3) and does not comprise a mercaptan and does not comprise a peroxide; and polymeric domain b) is free of the compound of formula (3)

wherein each of the polymeric domains a) and b) comprise a polypropylene, wherein the compound of formula (3) is present in polymeric domain a) in an amount of 0.001 to 0.01% by weight, and wherein formula (3) is:

(3)

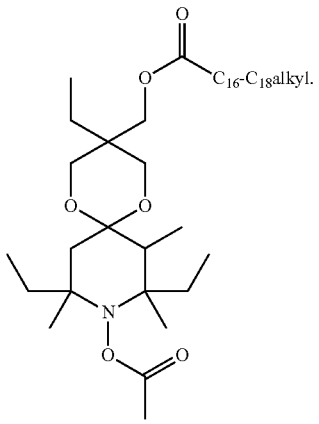

2. A bicomponent fiber, comprising at least two distinct polymeric domains a) and b) in intimate adherence along the length of the bicomponent fibers, wherein polymeric domain a) comprises a compound of formula (3) and does not comprise a mercaptan and does not comprise a peroxide;

and polymeric domain b) is free of the compound of formula (3), and wherein each of the polymeric domains a) and b) comprise a polypropylene, wherein the compound of formula (3) is present in polymeric domain a) in an amount of 0.001 to 0.01% by weight, and wherein the formula (3) is:

(3)

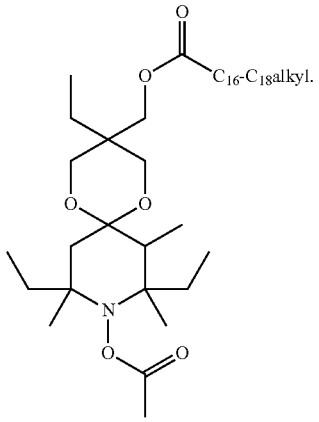

3. The nonwoven fabric of claim 1, wherein the bicomponent fibers are sheath-core bicomponent fibers.

4. The bicomponent fiber of claim 2, wherein the bicomponent fibers are sheath-core bicomponent fibers.

5. The nonwoven fabric of claim 3, wherein the polymeric domain a) forms the sheath and the polymeric domain b) forms the core.

6. The bicomponent fiber of claim 4, wherein the polymeric domain a) forms the sheath and the polymeric domain b) forms the core.

7. The nonwoven fabric of claim 1, wherein the bicomponent fibers comprise 20 to 80 weight percent of polymeric domain a) and 20 to 80% by weight of polymeric domain b).

8. The bicomponent fiber of claim 2, wherein the bicomponent fibers comprise 20 to 80 weight percent of polymeric domain a) and 20 to 80% by weight of polymeric domain b).

9. The nonwoven fabric of claim 1, wherein domain b) is free of mercaptan and peroxide.

10. The bicomponent fiber of claim 2, wherein domain b) is free of mercaptan and peroxide.

11. The nonwoven fabric of claim 1, wherein the compound formula (3) is present in polymeric domain a) in an amount of about 0.01% by weight.

12. The bicomponent fiber of claim 2, wherein the compound of formula (3) is present in polymeric domain a) in an amount of about 0.01% by weight.

13. The nonwoven fabric of claim 1, wherein the polymers in both of the polymeric domains a) and b) consists of polypropylene.

14. The nonwoven fabric of claim 1, wherein polymeric domain a) consists of polypropylene and a compound of formula (3) and wherein polymeric domain b) consists of polypropylene.

15. The nonwoven fabric of claim 5, wherein the polymers in both of the polymeric domains a) and b) consists of polypropylene.

16. The nonwoven fabric of claim 15, wherein polymeric domain a) consists of polypropylene and a compound of formula (3) and wherein polymeric domain b) consists of polypropylene.

17. The nonwoven fabric of claim 6, wherein the polymers in both of the polymeric domains a) and b) consists of polypropylene.

18. The nonwoven fabric of claim 17, wherein polymeric domain a) consists of polypropylene and a compound of formula (3) and wherein polymeric domain b) consists of polypropylene.

19. The nonwoven fabric of claim 1, wherein the bicomponent fibers comprise 10 to 30 weight percent of polymeric domain a) and 70 to 90% by weight of polymeric domain b).

* * * * *